US008589152B2

(12) United States Patent
Emori et al.

(10) Patent No.: US 8,589,152 B2
(45) Date of Patent: Nov. 19, 2013

(54) DEVICE, METHOD AND PROGRAM FOR VOICE DETECTION AND RECORDING MEDIUM

(75) Inventors: Tadashi Emori, Tokyo (JP); Masanori Tsujikawa, Tokyo (JP)

(73) Assignee: NEC Corporation, Tokyo (JP)

( * ) Notice: Subject to any disclaimer, the term of this patent is extended or adjusted under 35 U.S.C. 154(b) by 534 days.

(21) Appl. No.: 12/993,134

(22) PCT Filed: May 26, 2009

(86) PCT No.: PCT/JP2009/059610

§ 371 (c)(1), (2), (4) Date: Nov. 17, 2010

(87) PCT Pub. No.: WO2009/145192

PCT Pub. Date: Dec. 3, 2009

(65) Prior Publication Data

US 2011/0071825 A1 Mar. 24, 2011

(30) Foreign Application Priority Data

May 28, 2008 (JP) ..... 2008-139541

(51) Int. Cl.
*G10L 21/02* (2013.01)
*G10L 11/06* (2006.01)

(52) U.S. Cl.
USPC ..... 704/226; 704/233; 704/214; 704/236; 704/208

(58) Field of Classification Search
USPC ..... 704/226, 233, 236, 214, 208
See application file for complete search history.

(56) References Cited

U.S. PATENT DOCUMENTS 5,012,519 A * 4/1991 Adlersberg et al. ..... 704/226
5,963,901 A * 10/1999 Vahatalo et al. ..... 704/233
6,449,593 B1 * 9/2002 Valve ..... 704/233
7,130,797 B2 * 10/2006 Beaucoup et al. ..... 704/233

(Continued)

FOREIGN PATENT DOCUMENTS

JP 9-212195 A 8/1997
JP 2000081900 A 3/2000

(Continued)

OTHER PUBLICATIONS

Zhao Li et al: "Robust Speech Coding Using Microphone Arrays", Signals Systems and Computers, 1997. Conf. record of 31st Asilomar Conf., Nov. 2-5, 1997, IEEE Comput. Soc. Nov. 2, 1997, pp. 44-48.*

(Continued)

*Primary Examiner* — Pierre-Louis Desir
*Assistant Examiner* — Abdelali Serrou

(57) ABSTRACT

To this end, a voice detection device includes a band-based power calculation unit that calculates a total of signal power values (sub-band power) of signals entered from the microphones from one preset frequency width (sub-band) to another. The voice detection device also includes a band-based noise estimation unit that estimates the sub-band based noise power, and a sub-band based SNR calculation unit. The sub-band based SNR calculation unit calculates a sub-band SNR from one sub-band to another to output the largest one of the sub-band SNRs as an SNR for a microphone of interest. The voice detection device further includes a voice/non-voice decision unit that determines the voice/non-voice using the SNR for the microphone of interest.

20 Claims, 5 Drawing Sheets

(56) References Cited

U.S. PATENT DOCUMENTS

| | | | | |
|---|---|---|---|---|
| 7,146,315 | B2 * | 12/2006 | Balan et al. | 704/233 |
| 7,174,022 | B1 * | 2/2007 | Zhang et al. | 381/92 |
| 7,359,520 | B2 * | 4/2008 | Brennan et al. | 381/92 |
| 7,724,891 | B2 * | 5/2010 | Beaucoup et al. | 379/406.02 |
| 8,046,219 | B2 * | 10/2011 | Zurek et al. | 704/233 |
| 8,238,573 | B2 * | 8/2012 | Ishibashi et al. | 381/92 |
| 8,244,528 | B2 * | 8/2012 | Niemisto et al. | 704/233 |
| 8,275,136 | B2 * | 9/2012 | Niemisto et al. | 381/58 |
| 8,379,875 | B2 * | 2/2013 | Hamalainen | 381/92 |
| 2002/0001389 | A1 * | 1/2002 | Amiri et al. | 381/56 |
| 2002/0198705 | A1 * | 12/2002 | Burnett | 704/214 |
| 2007/0027685 | A1 * | 2/2007 | Arakawa et al. | 704/226 |
| 2007/0233479 | A1 * | 10/2007 | Burnett | 704/233 |

FOREIGN PATENT DOCUMENTS

| | | | |
|---|---|---|---|
| JP | 3163109 | B2 | 2/2001 |
| JP | 3163109 | B | 5/2001 |
| JP | 3218681 | B2 | 8/2001 |
| JP | 3218681 | B | 10/2001 |
| JP | 2002502193 | A | 1/2002 |
| JP | 3588030 | B2 | 8/2004 |
| JP | 3588030 | B | 11/2004 |
| JP | 2005308771 | A | 11/2005 |
| JP | 2007068125 | A | 3/2007 |

OTHER PUBLICATIONS

Li Ye ; Wang Tong ; Cui Huijuan ; Computational Engineering in Systems Applications, IMACS Multiconference on Li et al. "Voice Activity Detection in Non-stationary Noise", Digital Object Identifier: 10.1109/CESA.2006.4281886 Publication Year: 2006 , vol. 2, pp. 1573-1575.*

International Search Report for PCT/JP2009/059610 mailed Jul. 7, 2009.

* cited by examiner

DEVICE, METHOD AND PROGRAM FOR VOICE DETECTION AND RECORDING MEDIUM

RELATED APPLICATION

The present application is the National Phase of PCT/JP2009/059610, filed May 26, 2009, which claims priority rights based on the Japanese Patent Application 2008-139541 filed on May 28, 2008. The total of the contents disclosed in the Application of the senior filing date is to be incorporated by reference herein.

TECHNICAL FIELD

This invention relates to a device, a method and a program for voice detection, and a recording medium. More particularly, it relates to a device, a method and a program for voice detection, and a recording medium, usable for detecting the voice domain in a dialog system that allows a plurality of speakers to utter simultaneously from different microphones allocated to them.

BACKGROUND

In a voice collection method, disclosed in Patent Document 1, an output from each of two microphones is divided into a plurality of frequency domains. The difference in parameter values of sound signals, arriving at the microphones, and which are variable by reason of microphone positions, is detected. Based on this difference in detection, frequency components of the respective sound signals are selected for sound source separation. The sound of interest is distinguished from the sound not of interest based on the difference in their frequency characteristics. The sound not of interest is suppressed in the frequency domain. The output frequency components of the respective sound signals are synthesized into sound source signals.

In a noise removal method, disclosed in Patent Document 2, an input time domain signal is separated into a plurality of subcomponents by a signal separation unit. The noise contained in the subcomponents, resulting from the signal separation, is estimated by a noise estimation unit, using the subcomponents. A noise removal unit removes the so estimated noise from the subcomponents.

Patent Document 1:
JP Patent Kokai Publication No. JP2000-081900A
Patent Document 2:
JP Patent Kokai Publication No. JP2005-308771A

SUMMARY

It is noted that the total contents disclosed in the above Patent Documents 1 and 2 are to be incorporated by reference herein. The following analysis is given on the part of the present invention.

The methods of the above mentioned Patent Documents 1 and 2 suffer from the problem that voice detection may not be correctly made, for the following reason, in a region where the voices of a plurality of speakers overlap, viz., in across-talk region. In the methods of the above mentioned Patent Documents 1 and 2, large-small comparison is first made of the power values of the frequency components of each microphone. The power values of certain predetermined frequency bands or all of the frequency bands are summed together to calculate the total power. As a result, priority is put on the voice of a speaker that has a globally larger power.

It is now presupposed that, during the time a speaker A in front of a microphone A is uttering, a speaker B in front of a microphone B has uttered. In such case, interchange of detection domains occurs at a time point when the large-small relationship between the voice power of the speaker A and that of the speaker B in interchanged. It may be feared at this time, that, insofar as the speaker A is concerned, detection is halted short while as yet his/her utterance has not come to a close and, insofar as the speaker B is concerned, detection is commenced only after some time lapse as from the start of his/her utterance. It may also be feared that, depending on the utterance timings of the speakers A and B, the voice from the microphones A and that from the microphone B are detected only in small chunks or fragments.

In view of the above depicted status of the art, it is an object of the present invention to provide a device, a method and a program for voice detection, and a recording medium, usable for detecting the voice domain in an interlocution system that allows a plurality of speakers uttering simultaneously from different microphones, according to which the voice may be detected to high accuracy in the cross-talk regions.

Thus, there is much to be desired in the art.

In a first aspect, a voice detection device according to the present invention includes a band-based power calculation unit that calculates, from one preset frequency band width (sub-band) to another, a total of values of the signal power entered from each of a plurality of microphones (sub-band power), and a band-based noise estimation unit that estimates the noise power from one sub-band to another. The voice detection device also includes a band-based SNR calculation unit that, from one sub-band to another, for each of the microphones, calculates a sub-band SNR, and that outputs a largest one of the sub-band SNRs for each microphone, as a microphone of interest, as being an SNR of a microphone of interest. The voice detection device further includes a voice/non-voice decision unit that determines the voice/non-voice for each microphone using the SNR of each microphone.

In a second aspect, for use in a dialog system in which a plurality of speakers are allowed to utter simultaneously from microphones allocated to them, a voice detection method for detecting a voice domain according to the present invention includes a band-based power calculation step that calculates, from one preset frequency band width (sub-band) to another, a total of values of the signal power entered from each of a plurality of microphones (sub-band power), and a band-based noise estimation step that estimates the noise power from one sub-band to another. The voice detection method also includes a band-based SNR calculation step that, from one sub-band to another, for each of the microphones, calculates a sub-band SNR, and that outputs a largest one of the sub-band SNRs for each microphone, as a microphone of interest, as being an SNR of a microphone of interest. The voice detection method further includes a voice/non-voice decision step that determines the voice/non-voice for each microphone using the SNR of each microphone.

In a third aspect, for use in a dialog system in which a plurality of speakers are allowed to utter simultaneously from microphones allocated to them, a voice detection program according to the present invention allows, in order to detect a voice domain, a computer system to execute a band-based power calculation processing that calculates, from one preset frequency band width (sub-band) to another, a total of values of the signal power entered from each of a plurality of microphones (sub-band power), and a band-based noise estimation processing that estimates the noise power from one sub-band to another. The program also allows the computer to execute a band-based SNR calculation processing that, from one subband to another, for each of the microphones, calculates a sub-band SNR, and that outputs a largest one of the sub-band SNRs for each microphone, as a microphone of interest, as being an SNR of a microphone of interest. The program further allows the computer to execute a voice/non-voice decision processing that determines the voice/non-voice for each microphone using the SNR of each microphone.

The meritorious effects of the present invention are summarized as follows.

According to the present invention, the voice may be detected to high accuracy in a region of overlap of the voices of a plurality of speakers (cross-talk region). The reason is that the power values of signals, entered from each of a plurality of microphones, may be summed together from one sub-band to another to calculate sub-band SNRs for a given microphone, and the largest one of the sub-band SNRs is used to make voice/non-voice decision for the microphone in question.

PREFERRED MODES

First Exemplary Embodiment

Figure 1:
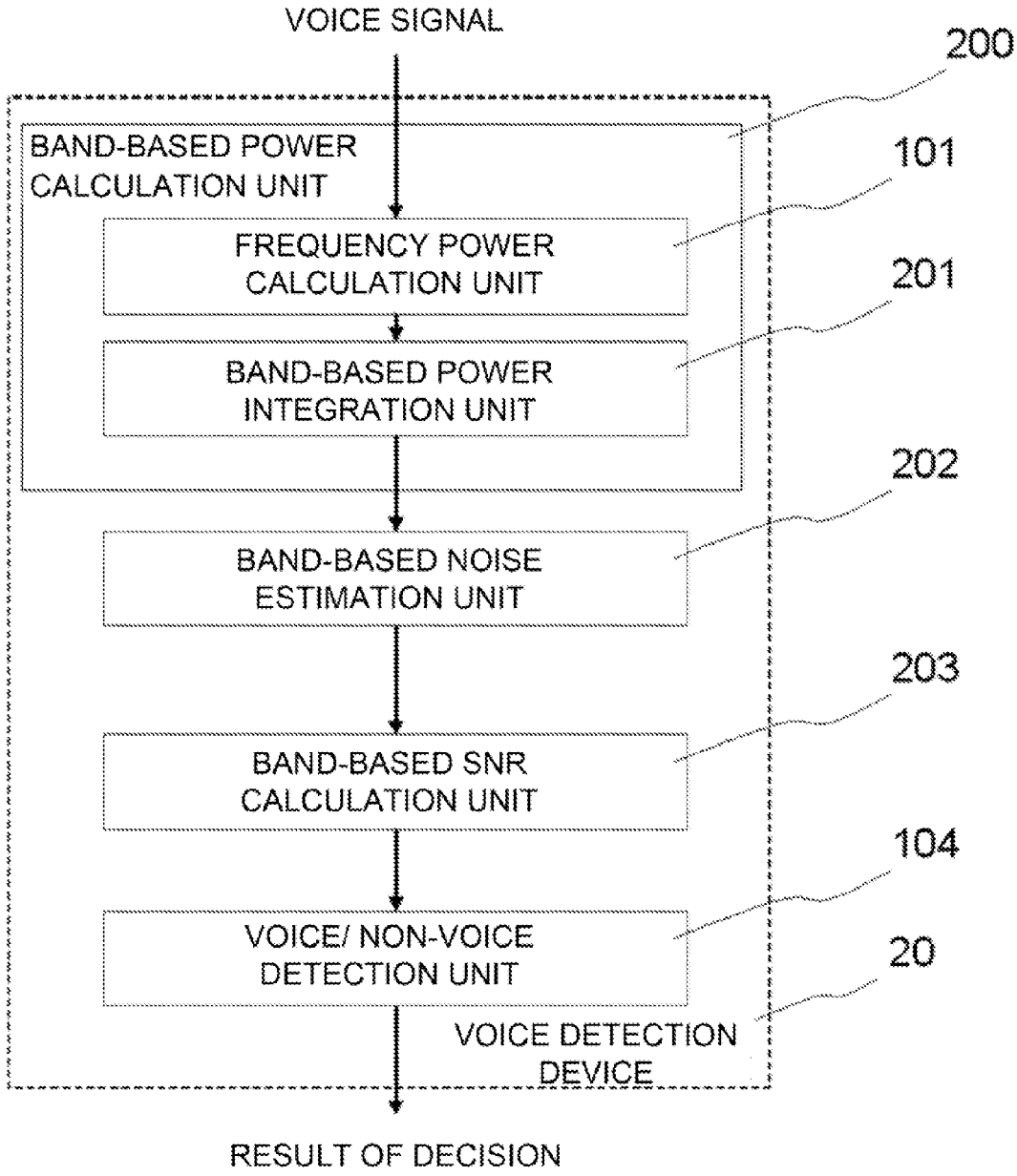
FIG. 1 is a block diagram showing an arrangement of a voice detection device according to a first exemplary embodiment of the present invention.

A first exemplary embodiment of the present invention will now be described with reference to the drawings. FIG. 1 depicts a block diagram showing an arrangement of a voice detection device according to the first exemplary embodiment of the present invention. Referring to FIG. 1, a voice detection device 20 according to the first exemplary embodiment includes a band-based power calculation unit 200, a band-based noise estimation unit 202, a band-based SNR calculation unit 203 and a voice/non-voice detection unit 104. It should be noted that processing operations to be carried out by the above mentioned processing means, namely the band-based power calculation unit 200 up to the voice/non-voice detection unit 104, as later explained, may be executed by a computer that constitutes the voice detection device 20. Or, the voice detection device may be implemented using a program that allows the computer to operate as individual processing means which will hereinafter be described.

The band-based power calculation unit 200 includes a frequency power calculation unit 101 and a band-based power integration unit 201.

The frequency power calculation unit 101 slices out an input signal at a preset interval of for example, 10 msec, and processes the so sliced out signal by pre-emphasis and windowing followed by FFT (Fast Fourier Transform). After the FFT, the frequency power calculation unit 101 calculates the power at a preset frequency division step of M to output the so calculated power values. For example, if a signal with a sampling frequency of 44.1 kHz is processed with FFT at 1024 points, the signal power may be calculated at an interval of approximately 43 Hz. This processing operation is carried out on each of a plurality of microphone signals entered simultaneously. It should be noted that the frequency-based power may be calculated by taking square sums of real and imaginary parts obtained on FFT. The power obtained at such constant frequency division step is here defined as the frequency power.

Based on these frequency power values, output from the frequency power calculation unit 101, the band-based power integration unit 201 finds a total of the frequency power values for each frequency division step of N, where N>M, to calculate a total of power values for each frequency division step of N. The frequency division step N is here termed the sub-band. The sub-band based power is termed a sub-band power. The band-based power integration unit 201 also saves the sub-band power values for a preset time duration, and calculates the sum of the power values of the preset time duration.

For the sub-band, a constant frequency division step N, where N>M, may be used. However, the width (frequency division step) of taking the sum may be varied from one frequency band to another. An example of varying the width (frequency division step) of taking the sum is varying the frequency division step according to the mel scale, by means of which the principal components of the voice may be expressed with emphasis. In calculating the mel frequency based total, the frequency division step becomes finer (narrower) for a low frequency range, while becoming coarser (broader) for a high frequency range. It should be noted that the sub-band power saving time interval may be constant, or may individually be set from one sub-band to another.

The band-based noise estimation unit 202 calculates the sub-band noise power which is the power of the sub-band based noise. The sub-band based noise power may be calculated in accordance with the following sequence from one sub-band to another. Initially, the sub-band power is compared from one microphone to another to select the microphone (speaker) with the maximum power value. The sub-band power is compared from one microphone to another to select the microphone with the minimum power value. The sub-band power of the so selected microphone with the minimum power value is stored. The above mentioned minimum power value stored is rendered the power of the sub-band noise associated with the microphone of the maximum power value. The sub-band noise power values of the remaining microphones are rendered the sub-band power values per se of these microphones. The reason the power values of the remaining microphones are rendered the sub-band power values per se of these microphones is that it is necessary to suppress the mistaken detection otherwise caused by the voice turning around. On the other hand, an SNR of the microphone with the maximum power value is enhanced because its noise power is replaced by the sub-band power of the minimum power value.

Figure 5:
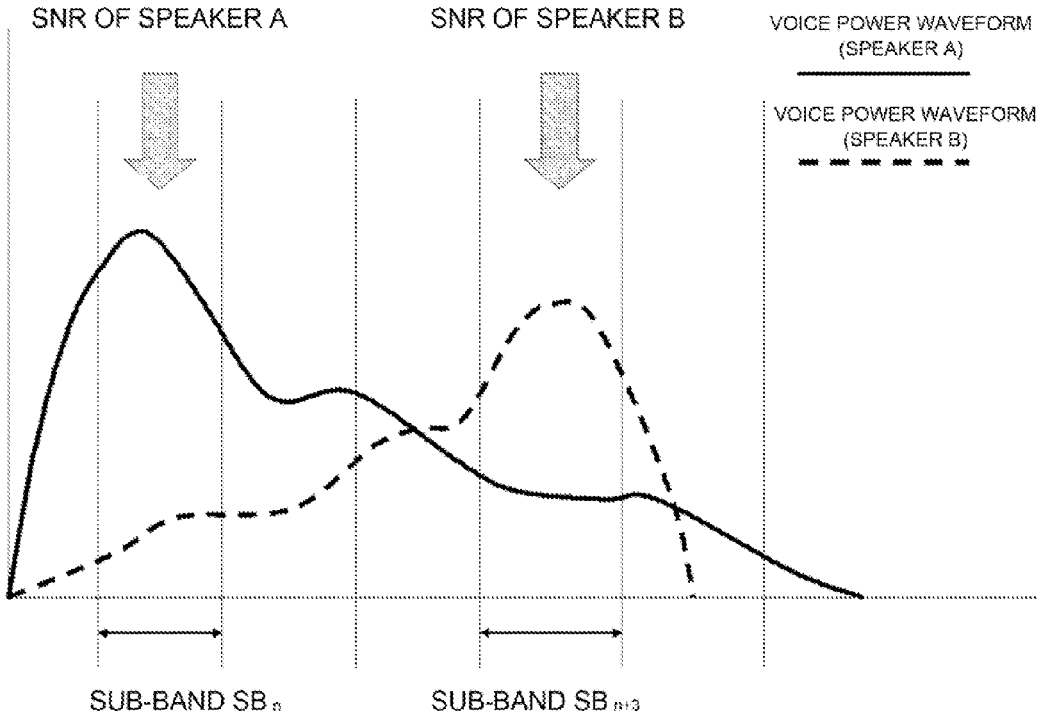
FIG. 5 is a graph for explanation of the principle of voice detection in a cross-talk region.

The above described processing of band-based noise estimation will now be described with reference to FIG. 5. It is assumed that, in the sub-band $SB_n$, the voice power of a speaker A, indicated by a solid line, is determined to be largest, and the voice power of a speaker B, indicated by a broken line, is determined to be smallest. In such case, the sub-band power of the speaker B is to become the sub-band noise power of the microphone used by the speaker A. It is then assumed that, in the sub-band the voice power of the speaker B, indicated by the broken line, is determined to be largest, and the voice power of the speaker A, indicated by the solid line, is determined to be smallest. In such case, the sub-band noise power of the microphone used by the speaker B is to become the sub-band power of the speaker A.

For each of the microphones, the band-based SNR calculation unit 203 divides the sub-band power with the sub-band noise power from one sub-band to another to find a sub-band based power ratio of the signal to the noise (SNR). This power ratio is termed the sub-hand SNR. The largest value ratio of the sub-band SNR, out of the sub-band SNRs, calculated from one microphone to another, is selected as the SNR of the microphone of interest.

The processing of calculating the band-based SNR will now be described with reference to FIG. 5. The sub-band SNRs are calculated for all of the sub-bands for the microphone used by the speaker A. The largest value one of the sub-band SNRs, for example, the sub-band SNR of the sub-band $SB_n$, is selected. This sub-band SNR is to be the SNR of the speaker A. In similar manner, for the microphone used by the speaker B, the sub-band SNRs are calculated for all of the sub-bands. The largest value one of the sub-band SNRs, for example, the sub-band SNR of the sub-band $SB_{n+3}$, is selected. This sub-band SNR is to be the SNR of the speaker B.

If the SNR, calculated for a given signal by the band-based noise estimation unit 203, is smaller than a preset threshold value, the voice/non-voice detection unit 104 determines the signal in question to be the non-voice. If the SNR is determined to be larger than the preset threshold value, the voice/non-voice detection unit 104 determines the signal in question to be the voice.

The SNR, calculated by the band-based SNR calculation unit 203 as described above, has taken into account the fact that, depending on the difference in quality of the voice from one speaker to another or on the difference in the contents being uttered, there may be cases where the voice uttered differs in frequency. See the voice power waveforms of the speakers A and B of FIG. 5. Viz., if, even in a cross-talk region of the speakers A and B, there is a difference of a peak value of one of the speakers from a peak value of the other speaker on the sub-band level, as in FIG. 5, it is possible to detect the voices of the two speakers independently of each other. As a result, voice detection may be performed with high robustness and high accuracy in an overlap region (cross-talk region) of utterances of a plurality of speakers.

To clarify the above mentioned advantageous effect of the above described exemplary embodiment, a formulation of FIG. 4, in which the frequency power values are not summed to form the sub-band power, will now be described with reference to FIG. 4. A noise estimation unit 102 calculates the noise power based on the frequency power values as calculated by the frequency power calculation unit 101. The noise power is calculated in accordance with the following sequence: First, the frequency power values of the microphones are compared to one another to select the microphone of the largest power. The values of the frequency power of the microphones are then compared to one another to select the microphone (speaker) of the smallest power. This smallest power is rendered the noise power of the microphone of the largest power. The noise power associated with the remaining microphones is rendered the frequency power of the microphones per se.

Figure 4:
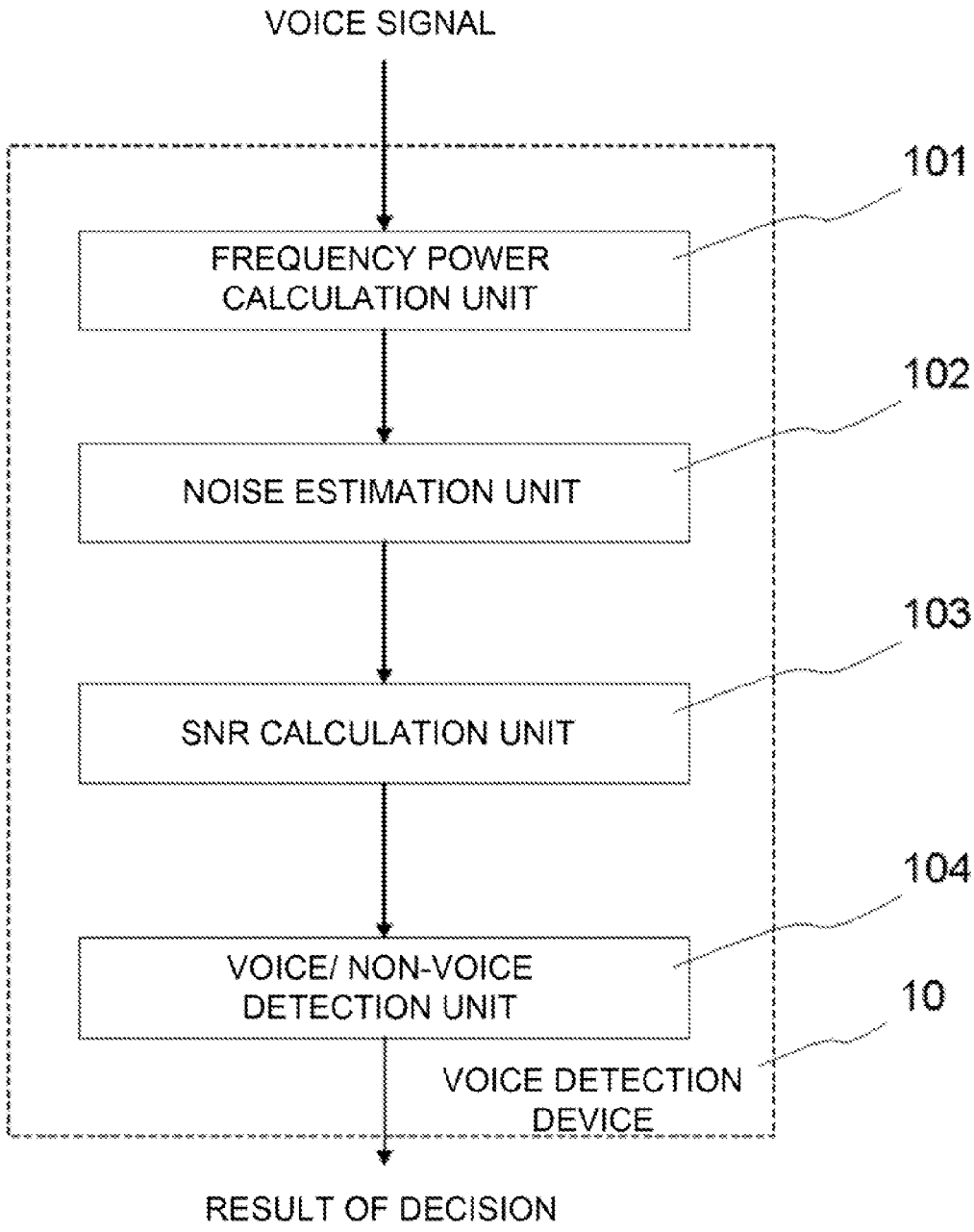
FIG. 4 is a block diagram showing a reference formulation of a voice detection device for explanation of an advantageous effect of the voice detection device according to the first exemplary embodiment of the present invention.

To calculate the power of the entire frequency range, an SNR calculation unit 103 of FIG. 4 sums the values of the power, as found from one frequency division step to another, over the entire frequency range. The noise estimation unit 102 sums the so determined values of the noise power from one frequency division step to another to find the noise power of the entire frequency range. The power of the entire frequency is divided by the noise power of the entire frequency to find an SNR. This SNR is found for signals of all of the microphones. This operation is tantamount to processing of finding the SNR from all of the areas of the waveform of FIG. 5. It should be noted that, in this case, the voice of the speaker B with the small total area may fail to be detected.

Thus, in the formulation of FIG. 4, the SNR is calculated for the entire frequency range. As a result, priority is placed on the voice of the speaker with the large global power. However, in the cross-talk regions, detection domain interchange may break out at a time juncture when the large power-small power order is interchanged. In such case, it may occur that detection of the utterance of the speaker, who started speaking at an earlier time, is halted while as yet the speaker's utterance has not come to a close. As for the speaker B, detection is commenced only after some time lapse as from the start of his/her utterance. In the arrangement of the present exemplary embodiment, on the other hand, the sub-band SNR is calculated from one sub-band to another for a given microphone and the largest sub-band SNR is set so as to be the microphone's SNR. Thus, under the premises that frequency components of two or more speakers may differ from each other, it is possible to detect the voices of the speakers in a cross-talk region.

Second Exemplary Embodiment

A second exemplary embodiment of the present invention takes into account possible applications of the present invention to an environment where the sorts of microphones used by speakers differ from one another or where the transmission systems of the input voices differ from one another. This second exemplary embodiment will now be described. It is presupposed that there are a plurality of microphones and a plurality of speakers each present in front of each of these microphones. Under this presupposition, the formulation of FIG. 4 is based on such premises that, out of the power values of input voice signals, as collected by a given microphone, the power of the voice of a speaker present before the microphone in subject is largest. Based on this presupposition, the values of the power obtained at the same time instant from the respective microphones are compared to one another and the signal of the maximum power is selected as the voice signal for each microphone.

In order for this presupposition to hold good, all of the microphones must be of the same sort, while the microphones and a sound recording or collecting section must be interconnected in the same way, as the matter of premises. On the other hand, the above premises may not hold good when the microphones are of variable sorts, for example, a fixed microphone or a pin microphone, or when the transmission systems between the microphones and the sound recording or collecting section are of variable types, as when the transmission used is a wired or wireless transmission system. In these cases, the microphones may be of variable characteristics, depending on their types, such that, if the signal of the same level is applied to these microphones, the power values derived from these microphones may differ from one microphone to another. It may also be feared that a signal obtained from a given microphone and transmitted over a transmission system, such as a wired or wireless transmission route, may arrive at the sound recording or collecting section at variable time points.

If these differences are taken into account, the presupposition of the formulation of FIG. 4 that the voice of the speaker present before a given microphone should become largest may fail to hold good. In addition, signal delay may be caused due to differences in the transmission system. In such case, the 'comparison of the signal power values at the same time point' may be rendered difficult, thus detracting from the performance in the voice domain detection.

Figure 2:
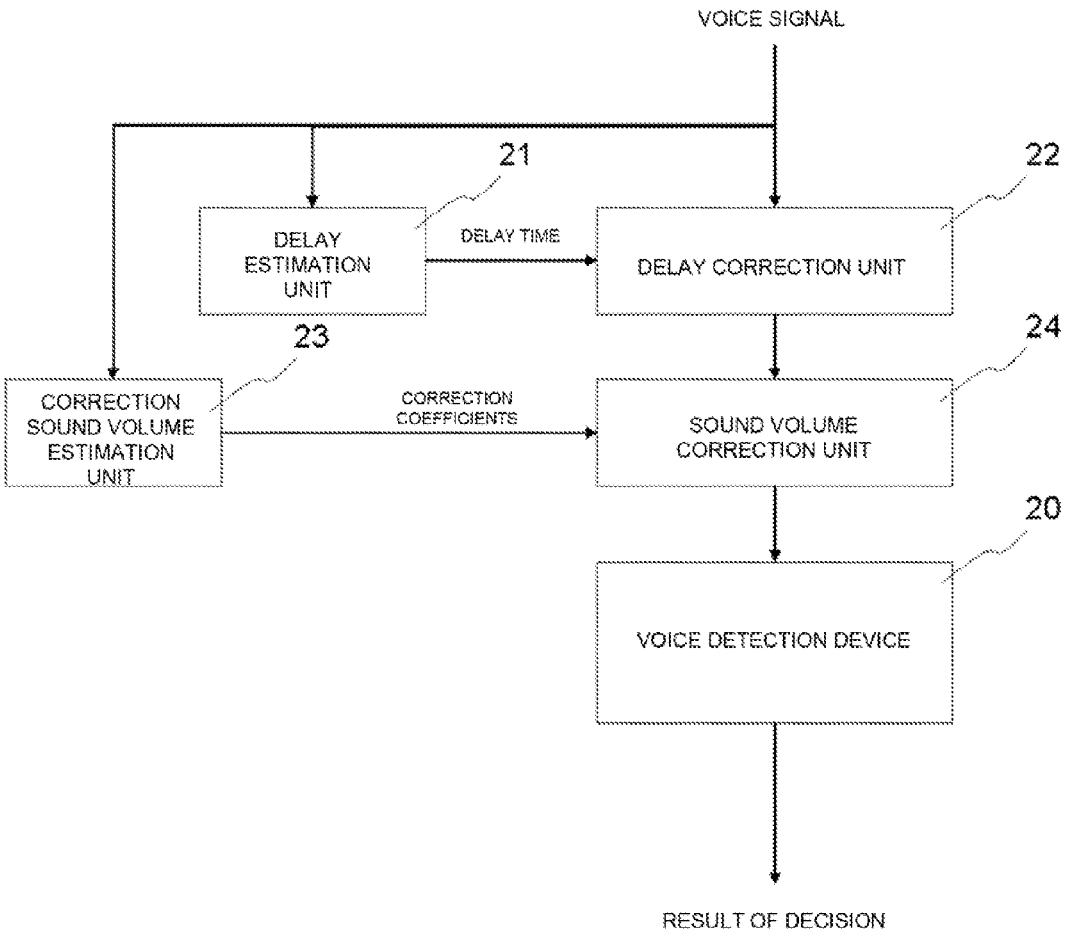
FIG. 2 is a block diagram showing an arrangement of a voice detection device according to a second exemplary embodiment of the present invention.

FIG. 2 shows a block diagram showing an arrangement of a voice detection device according to a second exemplary embodiment of the present invention. Referring to FIG. 2, the sound detection device according to the present invention includes a delay estimation unit 21, a delay correction unit 22, a correction sound volume estimation unit 23 and a sound volume correction unit 24, in addition to the voice detection device 20. This voice detection device may be the same as that shown in connection with the first exemplary embodiment or with the reference formulation of FIG. 4.

The delay estimation unit 21 calculates the power of the voice at a stated interval, from one microphone to another, in order to make the measurement of the time point of rapid rise in the power value. The delay estimation unit calculates a difference from an earliest one of time points of such rapid rises in the power value, and outputs the difference as delay time to the delay correction unit 22. At this time, the power may be calculated as a square sum of the waveforms of division steps of A/D conversion. The time juncture of rapid rise in the power value may be such a time juncture when the power has become larger than a preset threshold value.

In the above described method, the delay time is estimated based on comparison of the power value itself with its threshold value. In an alternative method, a preset time span as from the start of sound recording is assumed to be a noise domain and, using this noise domain, the power of the steady-state noise is estimated. Then, a ratio between the power value of the steady-state noise and each of the signal power values at each time point of power measurement is found as an SNR, and the time point when the SNR has become larger than a threshold value is then found. Such time point is found from one microphone to another. The delay time may be measured by subtracting an earliest one of the time points of the microphones from the time point as measured with each microphone.

The delay correction unit 22 holds the input signal from each microphone for a preset time duration and outputs it at a timing hastened by a time corresponding to the delay time output from the delay estimation unit 21. It should be noted that the lower limit of the volume of the signal held by the delay correction unit 22 is to be not less than the delay caused between the microphones, that is, the differences of signal arrival timings. For example, if no delay is caused in the first microphone and a delay of 500 msec is caused in the second microphone, the delay time of 500 msec is output as the delay time from the delay estimation unit 21. The delay correction unit 22 then outputs the signal of the first microphone after a delay time of 500 msec.

In more detail, in case an input signal is subjected to A/D conversion, with the sampling frequency of 44.1 kHz and the number of quantization bits of 24, 22050 samples are held as a 500 msec signal. The memory used for holding this signal is termed a buffer. The delay correction unit 22 takes out the signal of the first microphone from the leading end of the buffer, while taking out the signal of the second microphone from the trailing end of the buffer. These signals of the first and second microphones are output simultaneously. Each time a new A/D converted signal is entered to the buffer, the old signal stored in the buffer is updated to the new signal. Thus, by continuing this sequence of operations, it is possible to output non-delayed signals on end.

The correction sound volume estimation unit 23 calculates power values of signals of the microphones for a preset time duration. After the calculations, the correction sound volume estimation unit divides the power values by the time duration to find averaged power values. The correction sound volume estimation unit then divides the power values of all of the microphones by the largest one of the averaged power values of the respective microphones. The correction sound volume estimation unit then outputs resulting values as correction coefficients to the sound volume correction unit 24. It should be noted that the signal used for calculating the correction coefficients may preferably be the signal equally supplied to the respective microphones, such as, for example, the background noise.

Or, the smallest power value or the smallest averaged power value, which may prove to be a reference power, may be selected in place of the largest averaged power value. The values of the ratio of the power values of the respective microphones to the so selected reference power may then be used as the correction coefficients.

The sound volume correction unit 24 multiplies the input signals from the respective microphones by the correction coefficients output from the correction sound volume estimation unit 23, and outputs the resulting signals. Specifically, the output signals may be obtained by multiplying the signals output from the A/D conversion by the above mentioned correction coefficients. An analog signal prior to the A/D conversion may be amplified by a general-purpose amplifier for audio equipment. This operation is to be carried out for each microphone signal.

The voice detection device of the present exemplary embodiment is configured for eliminating the delay and differences in the sound volume, otherwise caused from one microphone to another, as described above. It is thus possible to improve the accuracy in voice detection in an environment with variable microphone types and variable transmission systems. The reason is that timing adjustment corresponding to the delay time as well as sound volume correction with the correction coefficients has already been made with the input signal.

In particular, if the present exemplary embodiment is applied to the voice detection device of the above described first exemplary embodiment, it is possible to further improve the voice detection accuracy in a cross-talk region. The arrangement of the present exemplary embodiment may, of course, be applied to the voice detection device shown in FIG. 4, in which case the accuracy in voice detection in an environment with variable microphone types and variable transmission systems may be improved.

Third Exemplary Embodiment

A third exemplary embodiment of the present invention, improved in connection with the above described second exemplary embodiment, will now be described in detail.

Figure 3:
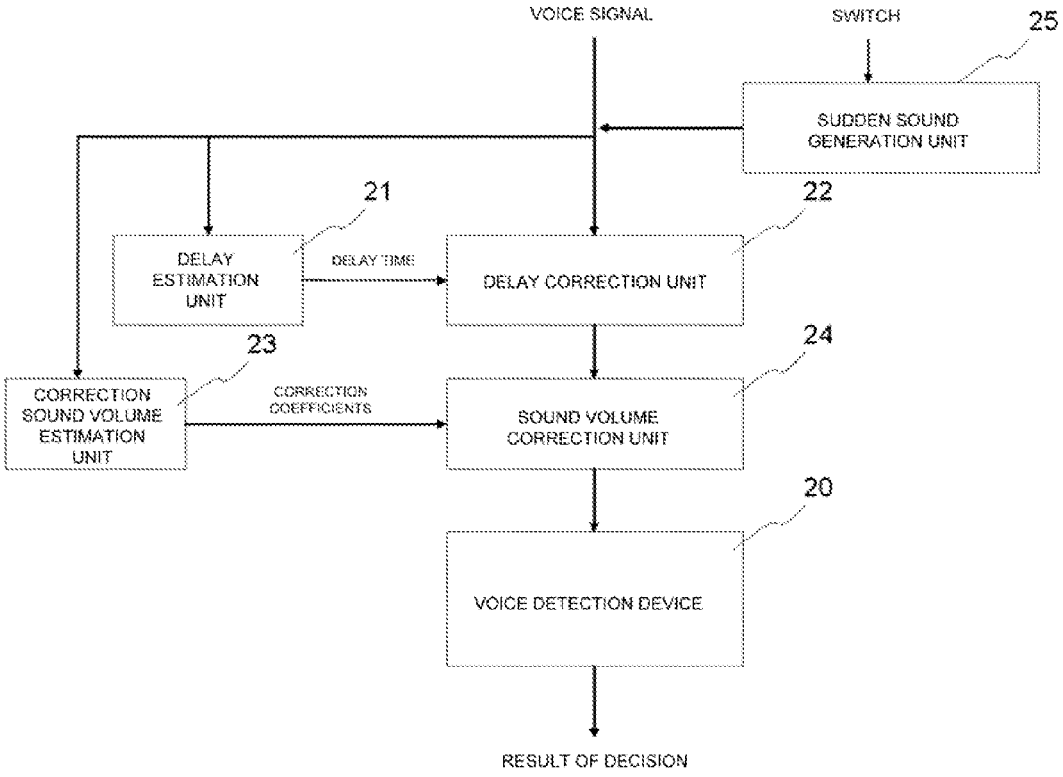
FIG. 3 is a block diagram showing an arrangement of a voice detection device according to a third exemplary embodiment of the present invention.

FIG. 3 depicts a block diagram showing an arrangement of a voice detection device according to the third exemplary embodiment. Referring to FIG. 3, the voice detection device according to the third exemplary embodiment is equivalent in its configuration to the above described second exemplary embodiment except that there is added a sudden sound generation unit 25.

The sudden sound generation unit 25 is run in operation by a preset starting means, such as a switch, and outputs a large sound (sudden sound). The sudden sound is preferably a sound that covers the entire frequency range and that has its power value enlarged precipitously.

The delay estimation unit 21 and/or the correction sound volume estimation unit 23 is set into operation by the abrupt sound output from the sudden sound generation unit 25, whereby it is possible to improve the measurement accuracy of the correction coefficients as well as the delay time. The delay time and the correction coefficients may both be correctly calculated if, in a room where a plurality of microphones of variable types are set, the sudden sound generation unit 25 is run into operation after keeping the room in a state of silence for some time long.

Although certain preferred exemplary embodiments of the present invention have so far been described, the present invention is not to be limited to these exemplary embodiments, such that further alterations, substitutions or adjustments may be made without departing from the fundamental technical concept of the present invention. For example, in an environment where no delay is likely to be caused, the delay estimation unit 21 and the delay correction unit 22 in the above described second and third exemplary embodiments may be dispensed with. In similar manner, in an environment where the difference in the sound volume is not likely to be produced, both the correction sound volume estimation unit 23 and the sound volume correction unit 24 in the above described second exemplary embodiment may be dispensed with.

In addition, in the above described first exemplary embodiment, the band-based power, that is, the sub-band power, is calculated by a setup composed of the frequency power calculation unit 101 and the band-based power integration unit 201. It is however possible to combine the frequency power calculation unit 101 and the band-based power integration unit 201 in one processing block in which to carry out the processing operations of the respective units.

It is to be noted that the equation for calculating the SNR or the signal power shown in the above described exemplary embodiments is given as only by way of examples for illustration. Viz., a variety of methods for calculations that may occur to those skilled in the art may be used without departing from the scope of the invention.

INDUSTRIAL APPLICABILITY

The present invention may be used for a variety of applications, including a voice detection device and a program for implementing the voice detection device on a computer. The particular exemplary embodiments or examples may be modified or adjusted within the gamut of the entire disclosure of the present invention, inclusive of claims, based on the fundamental technical concept of the invention. Further, a wide variety of combinations or selections of elements disclosed herein may be made within the framework of the claims. That is, the present invention may encompass a variety of modifications or corrections that may occur to those skilled in the art in accordance with and within the gamut of the entire disclosure of the present invention, inclusive of claim and the technical concept of the present invention.

Mode 1

In the following, preferred modes are summarized. (refer to the voice detection device of the first aspect)

Mode 2

The voice detection device according to mode 1, wherein said band-based noise estimation unit sets the sub-band noise power of other microphones so as to be the sub-band power of said other microphones.

Mode 3

The voice detection device according to mode 1 or 2, wherein said sub-band is set so as to be narrower in width in a low frequency range and so as to be broader in width in a high frequency range.

Mode 4

The voice detection device according to any one of modes 1-3, further comprising:

a delay correction unit that corrects the delay of a signal entered from each of said microphones.

Mode 5

The voice detection device according to any one of modes 1-4, further comprising:

a sound volume correction unit that corrects the sound volume of a signal entered from each of said microphones.

Mode 6

The voice detection device according to mode 4 or 5, further comprising:

a delay time measurement unit that measures time points of rapid change in the power values of signals from said microphones to output the differences between said time points as the delay time to said delay correction unit.

Mode 7

The voice detection device according to mode 5 or 6, further comprising:

a correction sound volume estimation unit that calculates the values of the ratio of the power values of the respective microphones to output the resulting ratio values as correction coefficients to said sound volume correction unit.

Mode 8

The voice detection device according to mode 6 or 7, further comprising:

a sudden sound generation unit that outputs an abrupt sound of a short time duration.

Mode 9

The voice detection device according to any one of modes 1-8, wherein said band-based power calculation unit calculates, from one preset frequency width (sub-band) to another, a total of power values for the preset frequency widths (sub-band power) for a preset time duration.

Mode 10

(refer to the voice detection method of the second aspect)

Mode 11

The voice detection method according to mode 10, wherein, said band-based noise estimation unit sets the sub-band noise power of other microphones so as to be the sub-band power of said other microphones.

Mode 12

The voice detection method according to mode 10 or 11, wherein said sub-band is set so as to be narrower in width in a low frequency range and so as to be broader in width in a high frequency range.

Mode 13

The voice detection method according to any one of modes 10-12, further comprising:

a delay correction step that corrects the delay of a signal entered from each of said microphones.

Mode 14

The voice detection method according to any one of modes 10-13, further comprising:

a sound volume correction step that corrects the sound volume of a signal entered from each of said microphones, Mode 15

The voice detection method according to mode 13 or 14, further comprising:

a delay time measurement step of measuring time points of rapid change in the power values of signals from said microphones to output the differences between said time points as the delay time to said delay correction unit.

Mode 16

The voice detection method according to mode 14 or 15, further comprising:

a correction sound volume estimation step that calculates the values of the ratio of the power values of the respective microphones to output the resulting ratio values as correction coefficients to said sound volume correction unit.

Mode 17

The voice detection method according to mode 15 or 16, wherein the delay time or the power ratio of signals from the respective microphones is calculated based on an output signal from a sudden sound generation unit that outputs a sudden sound of a short time duration.

Mode 18

The voice detection method according to any one of modes 10-17, wherein said band-based power calculation step calculates, from one frequency width (sub-band) to another, for a preset time duration, a total of power values at an interval of said frequency width for a preset time duration.

Mode 19

(refer to the voice detection program of the third aspect)

Mode 20

The voice detection program according to mode 19, wherein, in said band-based noise estimation processing, said band-based noise estimation unit sets the sub-band noise power of other microphones so as to be the sub-band power of said other microphones.

Mode 21

The voice detection program according to mode 19 or 20, wherein said sub-band is set so as to be narrower in width in a low frequency range and so as to be broader in width in a high frequency range.

Mode 22

The voice detection program according to any one of modes 19-21, wherein the program further allows a computer to execute a delay correction processing that corrects the delay of a signal entered from each of said microphones.

Mode 23

The voice detection program according to any one of modes 19-22, further comprising:

a sound volume correction processing that corrects the sound volume of a signal entered from each of said microphones.

Mode 24

The voice detection program according to mode 22 or 23, further comprising:

a delay time measurement processing of measuring time points of rapid change in the power values of signals from said microphones to output the differences between said time points as the delay time to said delay correction unit.

Mode 25

The voice detection program according to mode 23 or 24, further comprising:

a correction sound volume estimation processing that calculates the values of the ratio of the power values of the respective microphones to output the resulting ratio values as correction coefficients to said sound volume correction unit.

Mode 26

The voice detection program according to mode 24 or 25, wherein the delay time or the power ratio of signals from the respective microphones is calculated based on an output signal from a sudden sound generation unit that outputs a sudden sound of a short time duration.

Mode 27

The voice detection program according to any one of modes 19-26, wherein said band-based power calculation processing calculates, from one frequency width to another, for a preset time duration, a total of power values at an interval of said frequency width for a preset time duration.

Mode 28

A recording medium having stored therein the program according to any one of modes 19 to 27.

What is claimed is:

1. A voice detection device comprising:

a band-based power calculation unit that calculates, for a plurality of subbands each having a preset frequency band width, a total of values of sub-band voice power entered from each of a plurality of microphones;

a band-based noise estimation unit that estimates noise power for the plurality of subbands;

a band-based signal-to-noise ratio (SNR) calculation unit that, for the plurality of subbands, for each of said microphones, calculates a sub-band SNR, and that outputs a largest sub-band SNR of said sub-band SNRs for each microphone as being an SNR of each respective microphone; and a voice/non-voice decision unit that determines a voice/non-voice for each microphone using said SNR of each microphone; wherein said band-based noise estimation unit compares, for a sub-band, said sub-band voice power from one microphone to another microphone to select one microphone with a larger sub-band voice power and another microphone with a smaller sub-band voice power; said band-based noise estimation unit setting, for the subband, the sub-band voice power of the microphone with the smaller sub-band voice power as the sub-band noise power of the microphone with the larger sub-band voice power.

2. The voice detection device according to claim 1, wherein said band-based noise estimation unit sets the sub-band noise power of other microphones so as to be the sub-band voice power of said other microphones.

3. The voice detection device according to claim 1, wherein said sub-band is set so as to be narrower in width in a low frequency range and so as to be broader in width in a high frequency range.

4. The voice detection device according to claim 1, further comprising:

a delay correction unit that corrects a delay of a signal entered from each of said microphones.

5. The voice detection device according to claim 1, further comprising:

a sound volume correction unit that corrects a sound volume of a signal entered from each of said microphones.

6. The voice detection device according to claim 4, further comprising:

a delay time measurement unit that measures time points of rapid change in power values of signals from said microphones to output the differences between said time points as the delay to said delay correction unit.

7. The voice detection device according to claim 5, further comprising:

a correction sound volume estimation unit that calculates values of a ratio of the power values of the respective microphones to output the resulting ratio values as correction coefficients to said sound volume correction unit.

8. The voice detection device according to claim 6, further comprising:

a sudden sound generation unit that outputs an abrupt sound of a short time duration.

9. The voice detection device according to claim 1, wherein said band-based power calculation unit calculates, from one sub-band to another sub-band, a total of sub-band powers comprising power values for the preset frequency widths for a preset time duration.

10. A voice detection method for detecting a voice domain, comprising:

a band-based power calculation step that calculates, for a plurality of subbands each having a preset frequency band width, a total of values of sub-band voice power entered from each of a plurality of microphones;

a band-based noise estimation step that estimates noise power for the plurality of subbands;

a band-based signal-to-noise ratio (SNR) calculation step that, for the plurality of subbands, for each of said microphones, calculates a sub-band SNR, and that outputs a largest sub-band SNR of said sub-band SNRs for each microphone as being an SNR of each respective microphone; and a voice/non-voice decision step that determines a voice/non-voice for each microphone using said SNR of each microphone; wherein said band-based noise estimation step compares, for a sub-band, said sub-band voice power from one microphone to another microphone to select one microphone with a larger sub-band voice power and another microphone with a smaller sub-band voice power; said band-based noise estimation step setting, for the subband, the sub-band voice power of the microphone with the smaller sub-band voice power as the sub-band noise power of the microphone with the larger sub-band voice power.

11. The voice detection method according to claim 10, wherein, said band-based noise estimation unit sets the sub-band noise power of other microphones so as to be the sub-band voice power of said other microphones.

12. The voice detection method according to claim 10, wherein said sub-band is set so as to be narrower in width in a low frequency range and so as to be broader in width in a high frequency range.

13. The voice detection method according to claim 10, further comprising:

a delay correction step that corrects a delay of a signal entered from each of said microphones.

14. The voice detection method according to claim 10, further comprising:

a sound volume correction step that corrects a sound volume of a signal entered from each of said microphones.

15. The voice detection method according to claim 13, further comprising:

a delay time measurement step of measuring time points of rapid change in power values of signals from said microphones to output the differences between said time points as the delay to be used in said delay correction step.

16. The voice detection method according to claim 14, further comprising:

a correction sound volume estimation step that calculates values of a ratio of power values of the respective microphones to output the resulting ratio values as correction coefficients to be used in said sound volume correction step.

17. The voice detection method according to claim 15, wherein the delay or the power ratio of signals from the respective microphones is calculated based on an output signal from a sudden sound generation unit that outputs a sudden sound of a short time duration.

18. The voice detection method according to claim 10, wherein said band-based power calculation step calculates, for each of the plurality of subbands, for a preset time duration, a total of power values at an interval of said frequency width for a preset time duration.

19. A non-transitory computer-readable recording medium having a program stored thereon, which causes a computer to execute:

a band-based power calculation processing that calculates, for a plurality of subbands each having a preset frequency band width, a total of values of sub-band voice power entered from each of a plurality of microphones;

a band-based noise estimation processing that estimates noise power for the plurality of subbands;

a band-based signal-to-noise ratio (SNR) calculation processing that, for the plurality of subbands, for each of said microphones, calculates a sub-band SNR, and that outputs a largest sub-band SNR of said sub-band SNRs for each microphone, as being an SNR of each respective microphone; and a voice/non-voice decision processing that determines a voice/non-voice for each microphone using said SNR of each microphone; wherein said band-based noise estimation processing compares, for a subband, said sub-band voice power from one microphone to another microphone to select one microphone with a larger sub-band voice power and another microphone with a smaller sub-band voice power; said band-based noise estimation processing setting, for the sub-band, the subband voice power of the microphone with the smaller sub-band voice power as the sub-band noise power of the microphone with the larger sub-band voice power.

20. The non-transitory computer-readable recording medium according to claim 19, wherein, in said band-based noise estimation processing, said band-based noise estimation unit sets the sub-band noise power of other microphones so as to be the sub-band voice power of said other microphones.

* * * * *